US006675551B1

(12) United States Patent
Fuchs

(10) Patent No.: US 6,675,551 B1
(45) Date of Patent: Jan. 13, 2004

(54) PLATE-SHAPED CONSTRUCTIONAL ELEMENT AND METHOD

(75) Inventor: Helmut Fuchs, Weil (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 09/786,120

(22) PCT Filed: Aug. 31, 1999

(86) PCT No.: PCT/EP99/06386

§ 371 (c)(1),
(2), (4) Date: Mar. 1, 2001

(87) PCT Pub. No.: WO00/14353

PCT Pub. Date: Mar. 16, 2000

(30) Foreign Application Priority Data

Sep. 2, 1998 (DE) ..... 198 39 973

(51) Int. Cl.[7] ..... E04B 1/82; E04C 2/54; E04C 2/34

(52) U.S. Cl. ..... 52/791.1; 52/144; 52/145; 52/787.11; 52/783.1

(58) Field of Search ..... 52/144, 145, 515, 52/787.11, 791.1, 793.1, 799.1, 783.1

(56) References Cited

U.S. PATENT DOCUMENTS

| | | | | | |
|---|---|---|---|---|---|
| 1,937,889 | A | * | 12/1933 | Howard | 181/293 |
| 3,769,767 | A | * | 11/1973 | Scott | 181/288 |
| 3,991,848 | A | | 11/1976 | Davis | |
| 4,317,503 | A | * | 3/1982 | Soderquist et al. | 181/290 |
| 4,433,021 | A | * | 2/1984 | Riel | 181/292 |
| 4,539,244 | A | * | 9/1985 | Beggs et al. | 181/292 |
| 5,009,043 | A | * | 4/1991 | Kurrasch | 181/290 |
| 5,700,527 | A | | 12/1997 | Fuchs et al. | |
| 5,740,649 | A | | 4/1998 | Fuchs et al. | |
| 5,765,334 | A | * | 6/1998 | Vitous | 181/294 |
| 5,832,685 | A | * | 11/1998 | Hermanson | 428/221 |
| 6,244,378 | B1 | * | 6/2001 | McGrath | 181/288 |
| 2001/0000734 | A1 | * | 5/2001 | Woods | 427/140 |

FOREIGN PATENT DOCUMENTS

| | | | |
|---|---|---|---|
| DE | 380 06 564 | A1 | 9/1988 |
| DE | 93 00 152 | U | 4/1993 |
| DE | 43 15 759 | C1 | 5/1994 |
| DE | 605 784 | A1 | 7/1994 |
| DE | 94 05 885 | U | 7/1994 |
| DE | 43 12 885 | A1 | 10/1994 |
| DE | 94 06 574 | U | 1/1995 |
| DE | 44 37 196 | | 3/1996 |
| DE | 297 13 040 | U | 11/1997 |
| DE | 197 54 107 | | 2/1999 |
| DE | 197 30 355 | C1 | 3/1999 |
| EP | 0 699 257 | | 3/1996 |

OTHER PUBLICATIONS

International Search Report for PCT/EP 99/06386 (Form PCT/ISA/210 dtd Dec. 22, 1999; mailed Jan. 12, 2000).

* cited by examiner

*Primary Examiner*—Carl D. Friedman
*Assistant Examiner*—Kevin McDermott
(74) *Attorney, Agent, or Firm*—Crowell & Moring LLP

(57) ABSTRACT

A plate-shaped constructional element comprises a perforated plate made of a solid material such as metal, wood, wood chip board, pressboard, synthetic material or gypsum, and is characterized by the provision that a micro-perforated sheet or thin plate is disposed on one of the plate surfaces of the plate. One variant provides that the holes in the plate are formed in such a manner that they open each into a micro hole on one side of the plate.

15 Claims, 2 Drawing Sheets

PLATE-SHAPED CONSTRUCTIONAL ELEMENT AND METHOD

This application claims the priority of German Patent Document 198 39 973.1, filed Sep. 2, 1998, and International Patent Application PCT/EP99/06386, filed Aug. 21, 1999.

BACKGROUND AND SUMMARY OF THE INVENTION

The present invention relates to a plate-shaped constructional element made of wood, synthetic material or gypsum plaster boards in accordance with claim 1.

From the German Patent DE 43 15 759 or the European Patent EP 699 257 (corresponding U.S. Pat. No. 5,700,527) a sound absorbing constructional element made of glass or transparent synthetic glass is known which when mounted as facing shell at a spacing from a window, facade or roof structure element absorbs sound in a frequency range determined by the geometric dimensions of the spacing, the thickness of the facing shell, the size and the number of the holes in the micro-perforation as well as by the material of the facing shell. In further embodiments the same plate with micro-perforations may also be designed as closed cassette absorbing on one side or as flat or wing absorbing on both sides, which may have any shape whatsoever and present micro-perforations in one or several layers.

From the German Patent DE 44 37 196 moreover a sound absorber according to DE 43 15 759 is known wherein two plates having large holes are superimposed on top of each other such that small holes form a micro-perforation between the two plates. That invention is already based on the idea to compose micro-perforated structural elements of any materials whatsoever which resist micro-perforation by drilling, lasering or punching. By filling fine-grained spacing materials into the space between the coarsely perforated plates or by displacement of the immediately superimposed coarsely perforated plates it is equally possible to vary the micro-perforation within wide limits.

The German Patent De 43 12 885 (corresponding U.S. Pat. No. 5,740,649) equally discloses a sound-absorbing metal cassette as suspended false ceiling wherein one or several micro-perforated sheets disposed in spaced tandem arrangement extract the energy from the sound waves incident from the room side by the provision that the air in the holes as one mass together with the air between the sheets cooperates with the rough ceiling to form a complex mass spring system with inherent friction in the small holes.

Eventually, a sound absorber consisting of micro-perforated sheets or thin plates is known from the German Patent DE 197 54 107, wherein several sheets or plates are provided in any arrangement relative to each other and suspended from the ceiling of a room or in a horizontal or oblique position in the space. As in this case a compressible air cushion is deliberately dispensed with the small holes become here accessible for the sound waves from both sides of the sheets or thin plates and are hence able to develop their attenuating effect even without the stimulation by a resonance mechanism. Moreover, according to the German Patents DE 197 10 920 and 197 30 355 an effect of flow past or through the micro-perforated sheets or plates, which amplifies the sound absorption in the small holes, is expediently utilized.

Furthermore, gypsum plaster boards or wood boards or particle boards with comparatively large holes are equally known wherein some sound-absorbing material such as glass or rock wool is disposed behind the plates or, in the case of a ceiling facing, placed on top. The fraction of the area of the holes amounts, as a rule, to approximately 30 to 90% even though it may be less and even become as low as 10%. Drilling micro-perforated holes in thick plates of 6 to 30 mm, for instance, is too expensive and the small holes—roughly 1 mm in size—would "heal up" again in wood boards or gypsum plaster boards because the wood fibres would extend into the interior of the hole and, in gypsum plaster boards, the fine gypsum would clog the holes.

The present invention is therefore based on the problem of providing a constructional element, which permits a low-cost utilization of the micro-perforation with application of a thick plate.

This problem is solved in accordance with the invention by the plate-shaped constructional element according to claim 1. Expedient embodiments of this constructional element are characterized in the dependent claims.

The issue of the present invention is the realization of a micro-perforation in comparatively thick plates or boards (approximately 6 to 30 mm thick) made of wood, synthetic material or gypsum plaster board, which absorb sound either as panels or cassettes of the type of a wall wainscoting or as suspended ceiling or even as jointless facing shell or part of a posted wall having a dual-shell structure.

DETAILED DESCRIPTION OF THE DRAWINGS

Figure 1:
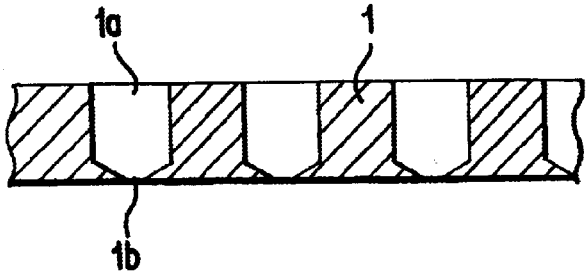
FIG. 1 is a sectional view of a plate shaped constructional element constructed in accordance with a preferred embodiment of the present invention.

The basic idea is again the attenuation of the vibrations of the air in small holes, with the thick plate actually including large holes which, however, open into small holes in correspondence with the patent documents referred to above. FIG. 1 shows, for instance, how the large holes 1*a* as such are tapering in the manner of drilled holes in the thick plate 1 which were not completely drilled through to open on one side into smaller holes 1*b* having a hole size, which is adjustable in dependence on the depth of the bores. This inventive way of formation can also be achieved by the operation in which the holes are first drilled with a drill having a wide diameter of up to roughly 1 mm, for instance, below the surface and then completely pierced through with the diameter of the micro bore. This variant shows, however, a solution which is possibly too expensive because the fraction of the hole area of the micro-perforated holes amounts only to less than 4%, expediently roughly 2 to 1%, and as with this variant too many holes with the wider diameter must be drilled.

Figure 2:
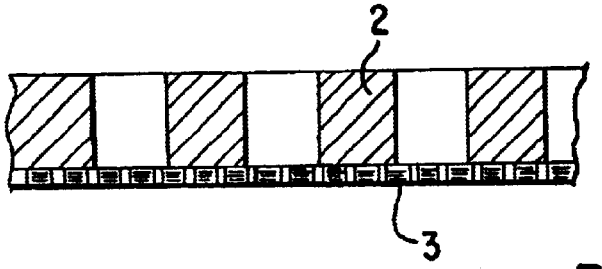
FIG. 2 is a sectional view of a plate shaped constructional element constructed in accordance with another preferred embodiment of the present invention.

FIG. 2 illustrates another, more expedient variant embodiment wherein a micro-perforated sheet, plate or board 3 having the actually desired hole pattern is attached on the "roughly" perforated plate (with large holes and a hole area fraction of 10–90%) in such a way that the hole fraction of the micro-perforated layer, which is left free, precisely furnishes the hole fraction required for absorption. This variant combines micro-perforated sheets or thin plates 3 which are made of plastic sheets, plywood or tissue, for instance, that are easy to manufacture, with thick perforated plates 2 having a hole fraction of 20 to 60%, which are equally easy to produce.

Figure 3:
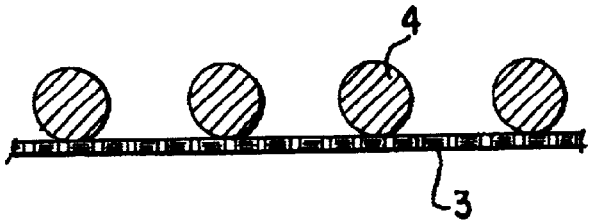
FIG. 3 is a sectional view of a plate shaped constructional element constructed in accordance with another preferred embodiment of the present invention.

Finally, FIG. 3 outlines a variant in which the thick plate that carries the micro-perforated constructional element 3 proper has been substituted by an equally load-bearing grid consisting of bars 4 or by a latticework.

All of these configurations have the common aspect that the stable substructure represents the actual structural element and that the micro-perforated layer is applied, e.g. by placing, so to speak, onto this element known per se and fixed or adhesively bonded only at the edges so that, in a figurative sense, small holes are created from large holes which let the sound pass without obstruction.

When constructional elements modified in this manner are disposed at a spacing from a reverberant wall or ceiling they are able to display an absorbing capacity like that of the aforedescribed constructional elements.

Figure 4:
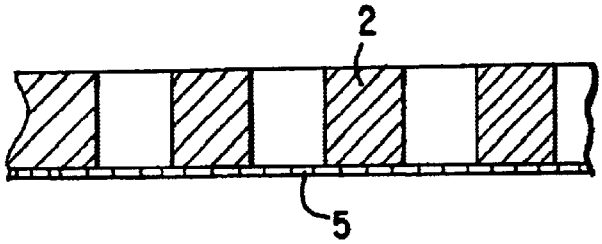
FIG. 4 PRIOR ART
FIG. 4 is a sectional view of a prior art plate shaped constructional element.

In prior art perforated panels made of wood, wood chips, pressboard or gypsum plaster board are provided in front of a reverberant rear wall relative to sound absorbers by introducing attenuating material, mostly artificial mineral fibres, into the air gap. Alternatively, a non-woven material or tissue 5 with a suitable flow resistance may also be placed or stretched on one side of a perforated plate 2 over its large holes (FIG. 4). All of these known sound absorbers with perforated plates present the disadvantage, however, that the porous materials will be soiled in the course of time as early as by the time of assembly and also subsequently on account of the air exchange between the facing ceiling cavity and the room to be attenuated, for instance. Hence the rough hole pattern remains also visible when the porous layer was turned towards the room.

The micro-perforated surfaces according to FIGS. 1 to 3, by contrast, create, towards the room, the optical impression of a closed surface of a constructional element when the holes have a diameter as small as a few millimeters, preferably less than 1 mm. Moreover, constructional elements according to FIGS. 1 to 3 are easy to clean and to varnish on their surface facing the room.

Figure 5:
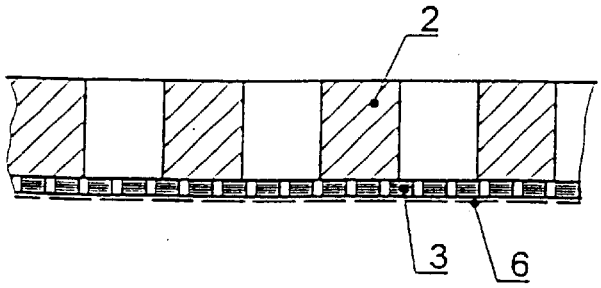
FIG. 5 is a sectional view of a plate shaped constructional element constructed in accordance with another preferred embodiment of the present invention.

In accordance with FIG. 5 it is additionally possible, or after the fixed installation on any substructure in front of walls or ceilings, to cover the constructional elements according to FIGS. 1 to 3, which face the room, with a non-woven material, a fabric or a porous wall paper 6 bonded thereon, in such a way that the small holes therebehind will be retained whilst the joints between adjacent constructional elements, however, are completely concealed by this surface treatment.

It is common, particularly in the formation of facing shells, light-weight walls and wainscotings with gypsum plaster board panels to fill the joints and seams between the contiguous panels first with a primer or to paste some kind of bandage over them. Even though this provision may result in a slight loss of the micro-perforation in the vicinity of the joint sites, the major part of the micro-perforated area is retained as such and can be protected from further covering in the manner roughly indicated in FIG. 5 by means of the thin porous and hence acoustically transmitting layer 6.

Compared against the common sound absorbers with perforated plates, including fibrous or porous attenuating material, a constructional element such as that roughly drawn in FIG. 5 presents the advantage that its absorption spectrum can be adjusted precisely in correspondence with the respective acoustic requirements only by the geometric parameters, as is disclosed in the quoted patent documents. It is therefore possible, for instance, that the higher frequency fractions, which are important for the audibility of language, are absorbed in the room to a lower extent while the frequently annoying lower frequency fractions are absorbed more strongly than in the porous or fibrous sound absorbers.

Figure 6:
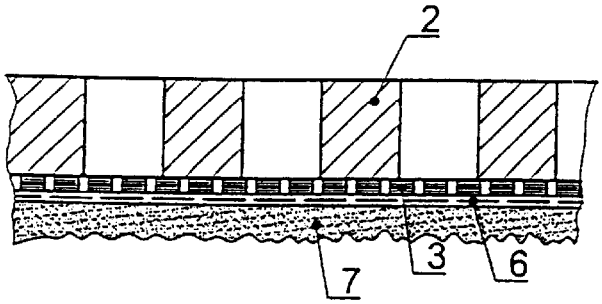
FIG. 6 is a sectional view of a plate shaped constructional element constructed in accordance with another preferred embodiment of the present invention.
Figure 7:
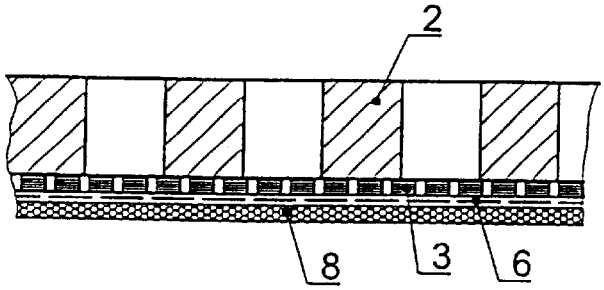
FIG. 7 is a sectional view of a plate shaped constructional element constructed in accordance with another preferred embodiment of the present invention.
Figure 8:
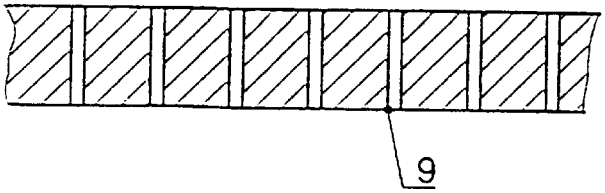
FIG. 8 is a sectional view of a plate shaped constructional element constructed in accordance with another preferred embodiment of the present invention.

When it is intended, however, to attenuate the higher frequency components, too, it is additionally possible, according to FIG. 6, to apply a further porous thicker layer of the kind of an acoustic plastering subsequently in the building. The sound-transmitting porous plaster or also a thicker layer of open-cell foamed material 8 according to FIG. 7, which may also have a pyramid structure, can also serve the purpose of concealing possibly existing irregularities on the joints between the plates or even in the substructure, the wall or the ceiling.

Following is a list of drawing reference numbers and a brief description of the corresponding structure:

1 thick (6 to 30 mm) perforated plate with large holes or bores strongly tapering towards the room side
2 thick perforated hole with a 20 to 60% surface fraction of large holes (2 to 30 mm)
3 thin micro-perforated sheet or plate with holes having a diameter smaller than 2 mm, preferably below 1 mm, and a hole surface fraction smaller than 4%, preferably below 2%
4 grating, wire mesh, slat substructure
5 fibrous non-woven material, tissue
6 porous thin layer
7 porous thicker layer
8 open-cell soft foam
9 "normal" thick micro-perforated plate

What is claimed is:

1. Plate-shaped constructional element defining at least part of any of wall wainscoting, a ceiling, a jointless facing shell, and a wall having a dual-shell structure, comprising:

a sound-absorbing perforated plate approximately 6 to 30 mm thick made of a solid material such as metal, wood, wood chip board, pressboard, synthetic material or gypsum, and a micro-perforated sheet or thin plate disposed on one of the plate surfaces of said perforated plate, wherein said perforated plate consists of a supporting structure or grating having a hole area fraction of 10–90%, and wherein said micro-perforated sheet or thin plate includes holes having diameters smaller than 2 mm and a hole area fraction smaller than 4% of the total area.

2. Constructional element according to claim 1, wherein the surface of said sheet or thin plate is subjected to one of a varnish and coating surface treatment.

3. Constructional element according to claim 1, wherein one of a non-woven material, a tissue and wallpaper is disposed on said sheet or thin plate.

4. Constructional element according to claim 1, wherein one of an acoustically transmitting paint coat and a thin porous material such as paper is applied on said sheet or thin plate.

5. Constructional element according to claim 1, wherein an acoustically transmitting thin porous material layer is applied on said sheet or thin plate, and wherein a thick porous layer such as an acoustic mortar is provided on said thin porous material layer.

6. Constructional element according to claim 1, wherein an open-cell foamed material is applied as a topmost layer on said sheet or thin plate.

7. Constructional element according to claim 1, wherein said holes have diameters smaller than 1 mm.

8. Constructional element according to claim 7, wherein said hole area fraction is smaller than 2% of the total area.

9. Constructional element according to claim 1, wherein said hole area fraction is smaller than 2% of the total area.

10. Plate shaped constructional element defining at least part of any of wall wainscoting, a ceiling, a jointless facing shell, and a wall having a dual-shell structure, comprising:

a thick sound-absorbing perforated supporting structure plate approximately 6 to 30 mm thick made of solid material, and a thin micro-perforated sheet disposed on one surface of the perforated supporting structure plate, wherein said perforated plate consists of a supporting structure or grating having a hole area fraction of 10–90%, and wherein said micro-perforated sheet or thin plate includes holes having diameters smaller than 2 mm and a hole area fraction smaller than 4% of the total area.

11. Plate shaped constructional element according to claim 10, wherein said thick supporting structure plate is perforated by through holes having respective hole diameters between 2 mm and 30 mm.

12. Plate shaped constructional element according to claim 10, wherein said thin micro-perforated sheet is formed as a paper sheet which is adhered to the thick supporting structure plate.

13. Plate shaped constructional element according to claim 10, wherein said thick supporting structure plate includes through holes exhibiting a total cross-sectional area of 20% to 30% of the total surface area of the thick supporting structure plate.

14. Plate shaped constructional element according to claim 13, wherein said thin micro-perforated sheet is formed as a paper sheet which is adhered to the thick supporting structure plate.

15. Plate-shaped constructional element comprising:

a perforated plate made of a solid material, and a micro-perforated sheet or thin plate disposed on one of the plate surfaces of said perforated plate, wherein an acoustically transmitting thin porous material layer is applied on said sheet or thin plate, and wherein a thick porous layer is provided on said thin porous material layer.

* * * * *